US006887002B1

(12) United States Patent
Chen

(10) Patent No.: US 6,887,002 B1
(45) Date of Patent: May 3, 2005

(54) KEYBOARD COVER

(76) Inventor: Yu-Pao Chen, 4F, No. 3, Lane 4, Ru-Yi St., Hsintien City, Taipei Hsien (TW)

( * ) Notice: Subject to any disclaimer, the term of this patent is extended or adjusted under 35 U.S.C. 154(b) by 27 days.

(21) Appl. No.: 10/734,477

(22) Filed: Dec. 12, 2003

(51) Int. Cl.[7] ..... B65D 65/00
(52) U.S. Cl. ..... 400/490; 400/472; 150/165; 150/154; 206/230
(58) Field of Search ..... 400/472, 490; 150/165, 162, 154; 206/305, 320, 701, 304.1

(56) References Cited

U.S. PATENT DOCUMENTS 4,762,226 A * 8/1988 Gatton ..... 206/320
5,080,155 A * 1/1992 Crozier ..... 150/154
5,944,432 A * 8/1999 Richardson ..... 400/713
6,772,881 B2 * 8/2004 Le et al. ..... 206/305

* cited by examiner

*Primary Examiner*—Andrew H. Hirshfeld
*Assistant Examiner*—Dave A. Ghatti
(74) *Attorney, Agent, or Firm*—William E. Pelton, Esq.

(57) ABSTRACT

A keyboard cover has a rectangular transparent film made of a soft material and having an upper side, a bottom side, two long sides and two short sides. Two first reinforcing strips are formed at the bottom side and respectively at the two long sides of the film. Two second reinforcing strips are formed at the bottom side and respectively at the two short sides of the film. Two elastic strips are respectively formed beneath the first reinforcing strips. Each of the elastic strips has two ends respectively bent upwards and inwards and fastened at the corresponding corners of the film. Whereby, a user's fingers will not directly touch a covered keyboard to prevent the keyboard from being contaminated by dirt or bacteria on a user's fingers.

4 Claims, 3 Drawing Sheets

KEYBOARD COVER

BACKGROUND OF THE INVENTION

1. Field of the Invention

The present invention relates a keyboard cover, and more particularly to a keyboard cover which can prevent a keyboard from being contaminated with water, dust, bacteria or viruses.

2. Description of Related Art

Computers, cash registers, etc are generally provided with a keyboard as an input device. However, because fingers of users will frequently contact with keys on the keyboard, the characters printed on the keys of the keyboard will fade after a term of time. Moreover, water, dust, dirt and bacteria on the fingers will contaminate the keyboard, so the users of the keyboard may be infected with various diseases.

Therefore, the invention provides a keyboard cover to mitigate or obviate the aforementioned problems.

SUMMARY OF THE INVENTION

The main objective of the present invention is to provide a keyboard cover which can prevent the keyboard from being contaminated by dirt or bacteria.

Other objectives, advantages and novel features of the invention will become more apparent from the following detailed description when taken in conjunction with the accompanying drawings.

BRIEF DESCRIPTION OF THF DRAWINGS

DETAILED DESCRIPTION OF THE PREFERRED EMBODIMENT

Figure 1:
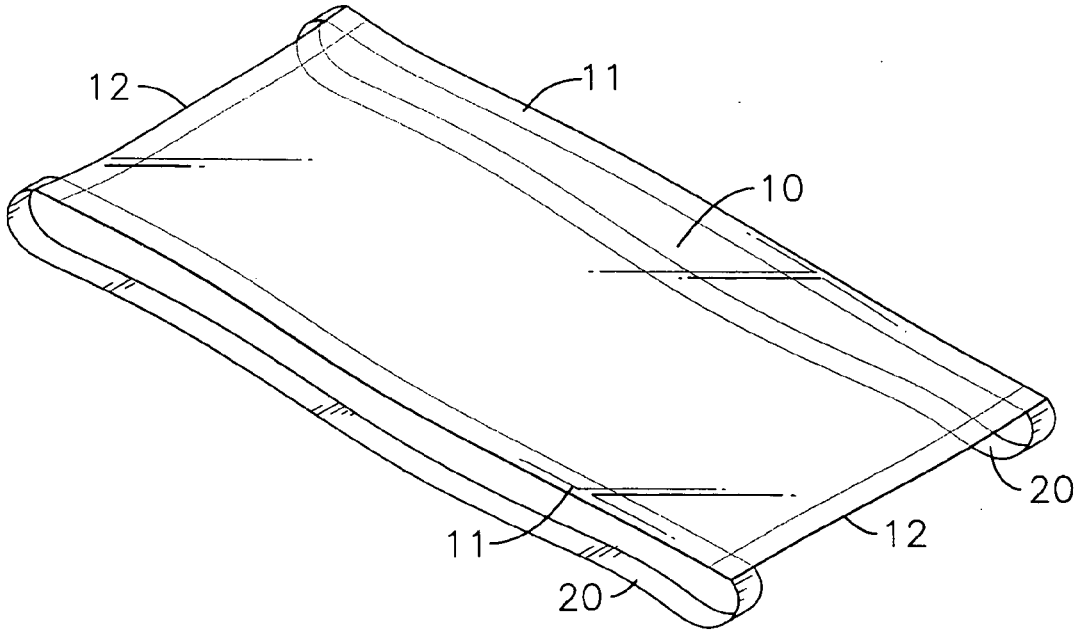
FIG. 1 is a perspective view of a keyboard cover in accordance with the present invention.
Figure 2:
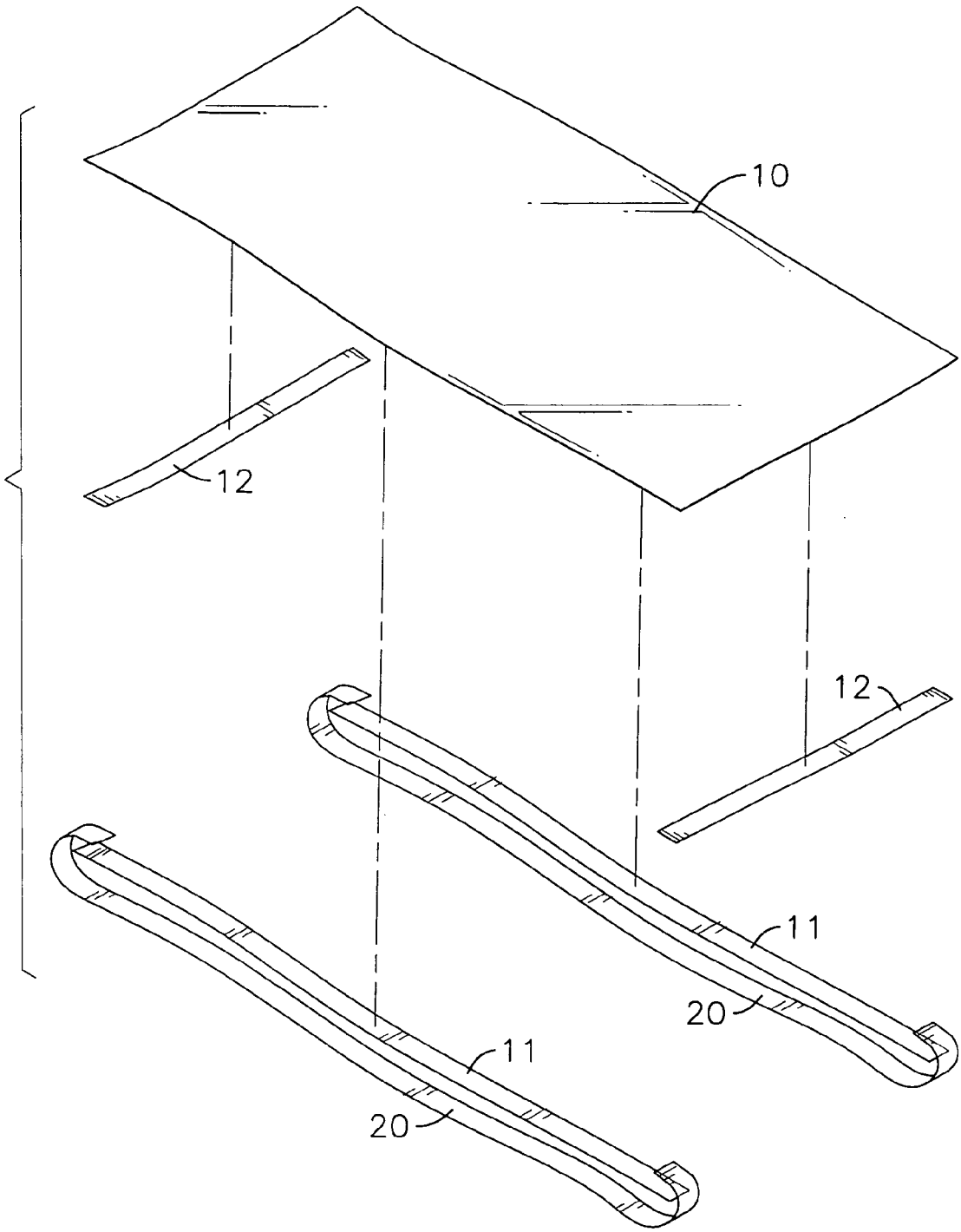
FIG. 2 is an exploded perspective view of the keyboard cover of FIG. 1.

With reference to FIGS. 1–2, a keyboard cover in accordance with the present invention has a rectangular transparent film (10) made of a soft material and with a top side, a bottom side, two long sides and two short sides.

Two first reinforcing strips (11) are provided at the bottom side and respectively at the two long sides of the film (10). Two second reinforcing strips (12) are provided at the bottom side and respectively at the two short sides of the film (10).

Two elastic strips (20) are respectively formed beneath the first reinforcing strips (11) and parallel to the first reinforcing strips (11). Each of the elastic strips (20) has two ends respectively bent upwards and inwards and fastened at the corresponding corners of the film (10). Therefore, the elastic strips (20) and the reinforcing strips (11) respectively constitute two loops (not numbered).

In this embodiment, the elastic strips (20) have a thickness greater than that of the first reinforcing strips (11), and the elastic strips (20) are combined with the first reinforcing strips (11) by means of heat pressing.

In another embodiment, the elastic strips (20) and the first reinforcing strips (11) can be replaced with two strip loops respectively formed at the long sides and the bottom sides of the film (10).

Figure 3:
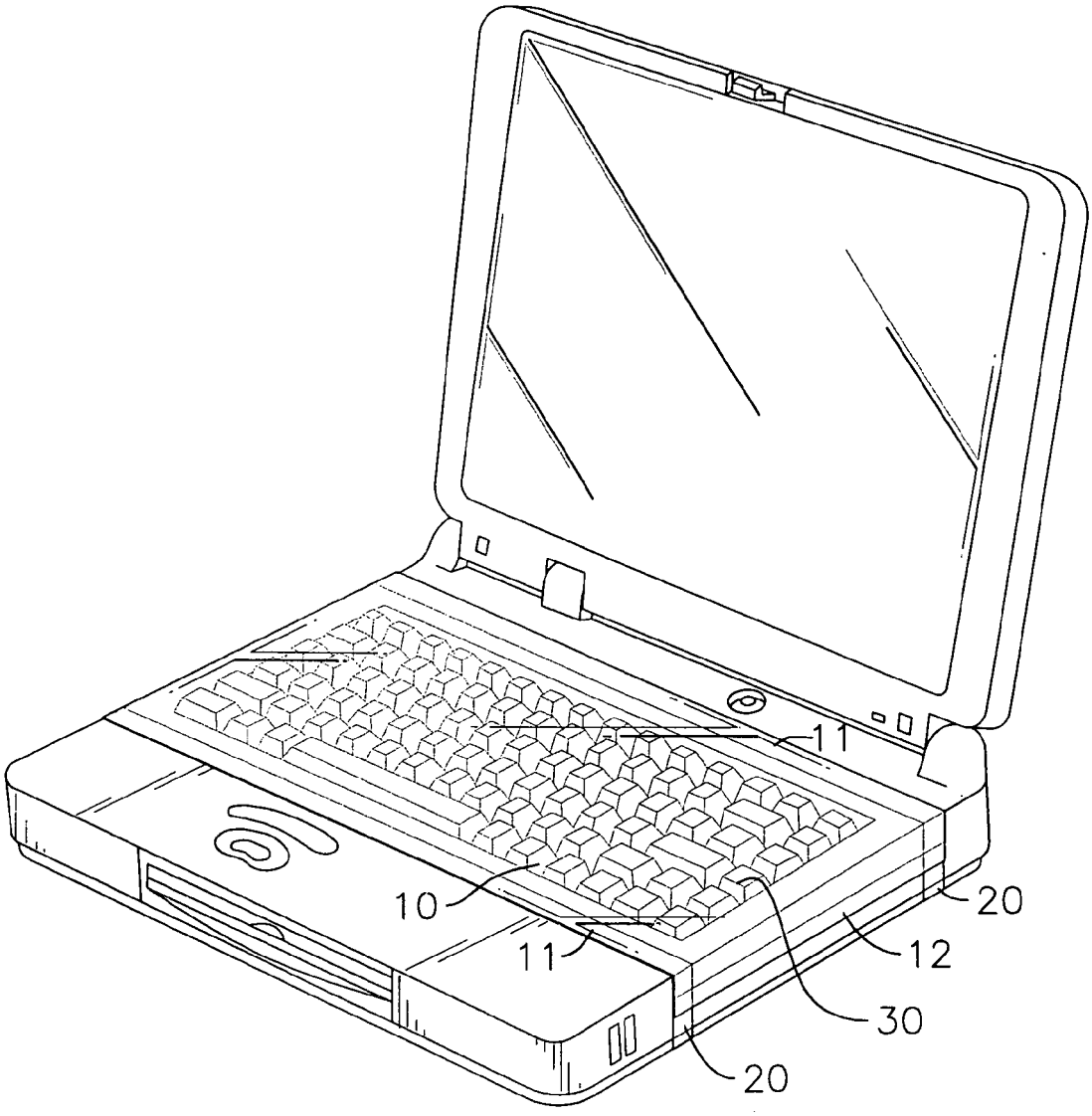
FIG. 3 is a schematic view of a keyboard of a notebook computer covered with the keyboard cover of the invention.

With reference to FIG. 3, a keyboard (30) of a notebook computer can be covered with the keyboard cover. A body of the notebook computer extends through the elastic strips (20) and the film (10) can be spread over the keyboard (30). Because the film (10) has a width and a length slightly greater than those of the keyboard (30), the film (10) can completely shield the keyboard (30).

Therefore, a user's fingers will not directly touch the keyboard and so the keyboard is prevented from being contaminated by dirt or bacteria on the fingers. Moreover, the keyboard also will not be contaminated by water or dust. Furthermore, wear of the contact faces of the keys is prevented because each face is no longer in direct contact with the user's fingers. Thus, the covered keyboard will have a long use life.

The keyboard cover made of soft material can be folded, so it is very convenient to carry the keyboard cover.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A keyboard cover comprising:

a rectangular transparent film made of a soft material and having atop side, a bottom side, two long sides and two short sides;

two first reinforcing strips formed at the bottom side and respectively at the two long sides of the film;

two second reinforcing strips formed at the bottom side and respectively at the two short sides of the film; and two elastic strips respectively formed beneath the first reinforcing strips, each elastic strip having two ends respectively bent upwards and inwards and fastened at the corresponding corners of the film.

2. The keyboard cover as claimed in claim 1, wherein the elastic strips are parallel to each other.

3. The keyboard cover as claimed in claim 1, wherein the elastic strips have a thickness greater than that of the reinforcing strips.

4. The keyboard cover as claimed in claim 3, wherein the elastic strips are combined with the first reinforcing strips by means of heat pressing.

* * * * *